US005655242A

United States Patent [19]

Chuang

[11] Patent Number: 5,655,242

[45] Date of Patent: Aug. 12, 1997

[54] TOOL COMBINATION FOR A BICYCLE

[76] Inventor: Louis Chuang, 7th-8, No. 20, Da Long Road, Taichung, Taiwan

[21] Appl. No.: 525,087

[22] Filed: Sep. 8, 1995

[51] Int. Cl.[6] ..... B25B 13/00

[52] U.S. Cl. ..... 7/138; 81/177.2; 7/100

[58] Field of Search ..... 7/138, 100; 81/177.2

[56] References Cited

U.S. PATENT DOCUMENTS

| | | | |
|---|---|---|---|
| 4,103,378 | 8/1978 | Grandaos | 7/138 |
| 5,251,341 | 10/1993 | Seals | 7/138 |
| 5,303,439 | 4/1994 | Seals | 7/138 |
| 5,477,758 | 12/1995 | Cunningham | 81/177.2 X |

*Primary Examiner*—James G. Smith
*Attorney, Agent, or Firm*—Charles E. Baxley, Esq.

[57] ABSTRACT

A tool combination for a bicycle includes a body having a socket secured on one end and having an engaging hole communicating with the socket. A rod has a block secured to one end and has a driving tool bit formed between the rod and the block for engaging with the engaging hole of the body so as to extend a driving length of the body. The block includes a middle portion having a slot for engaging with a chain and includes a screw hole for engaging with a bolt which has an extension for disengaging the pivot shafts from the chain so as to fix the chain.

2 Claims, 3 Drawing Sheets

TOOL COMBINATION FOR A BICYCLE

BACKGROUND OF THE INVENTION

1. Field of the Invention

The present invention relates to a tool, and more particularly to a tool combination for bicycles.

2. Description of the Prior Art

Typical bicycles comprise a rather compact bicycle frame which includes no rooms or spaces for storing repairing tools such that no special repairing tools are developed for bicycles. In order to repair bicycles, the users have to prepare a lot of screw drivers, wrenches. In addition, when the chain become loose, no tools are provided for disengaging the pivot shaft of the chain so as to tighten the chain.

U.S. Pat. No. 4,967,435 to Seals and U.S. Pat. No. 5,303,439 to Seals disclose two types of multipurpose bicycle tool kits and each includes an elongated handle, a socket, a second end and two allen wrenches engagable with each other. However, the allen wrenches may not be stably secured to the handle and may be easily disengaged from the handle and will be easily lost. In addition, the handle includes a predetermined length and may not be lengthened for increasing the torque for the tool.

The present invention has arisen to mitigate and/or obviate the afore-described disadvantages of the conventional tools for bicycles.

SUMMARY OF THE INVENTION

The primary objective of the present invention is to provide a tool combination which includes a plurality of tool bits and engaging surfaces provided thereon for driving fastening members and which includes a device for disengaging pivot shafts of chains.

In accordance with one aspect of the invention, there is provided a tool combination for a bicycle comprising a body including a first end having a first socket secured thereon and having a first engaging hole formed therein and communicating with the socket, the body including at least one first driving means provided thereon and including at least one second engaging hole formed therein, and a rod including a first end having a block secured thereto and including a third driving means formed between the rod and the block for engaging with the first engaging hole of the body so as to extend a driving length of the body.

The block includes a middle portion having a slot formed therein for engaging with chain means having pivot shafts therein, the block includes a first end having a screw hole formed therein for engaging with a bolt means, the bolt means includes an extension for disengaging the pivot shafts from the chain means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
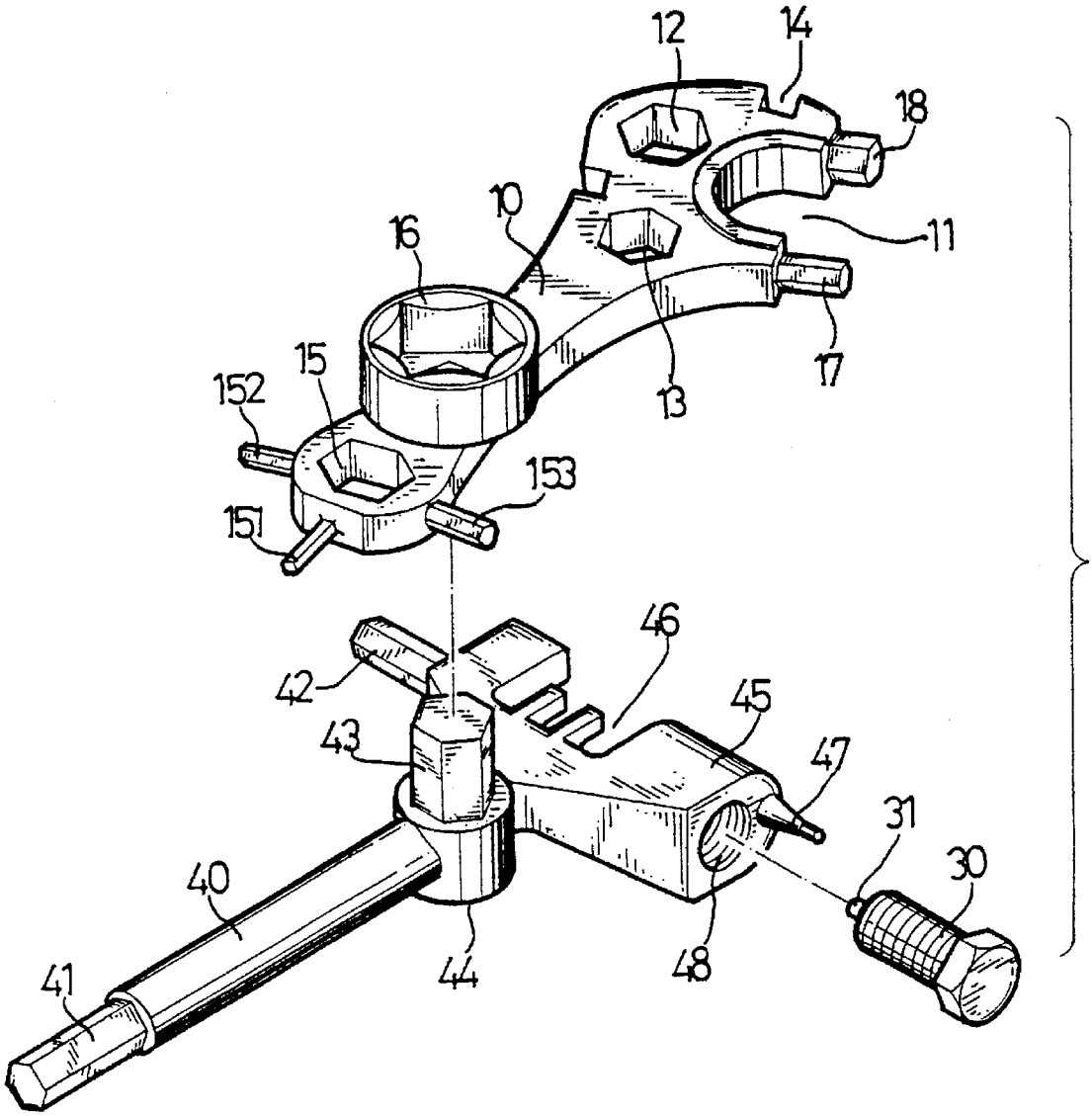
FIG. 1 is an exploded view of a tool combination in accordance with the present invention.
Figure 2:
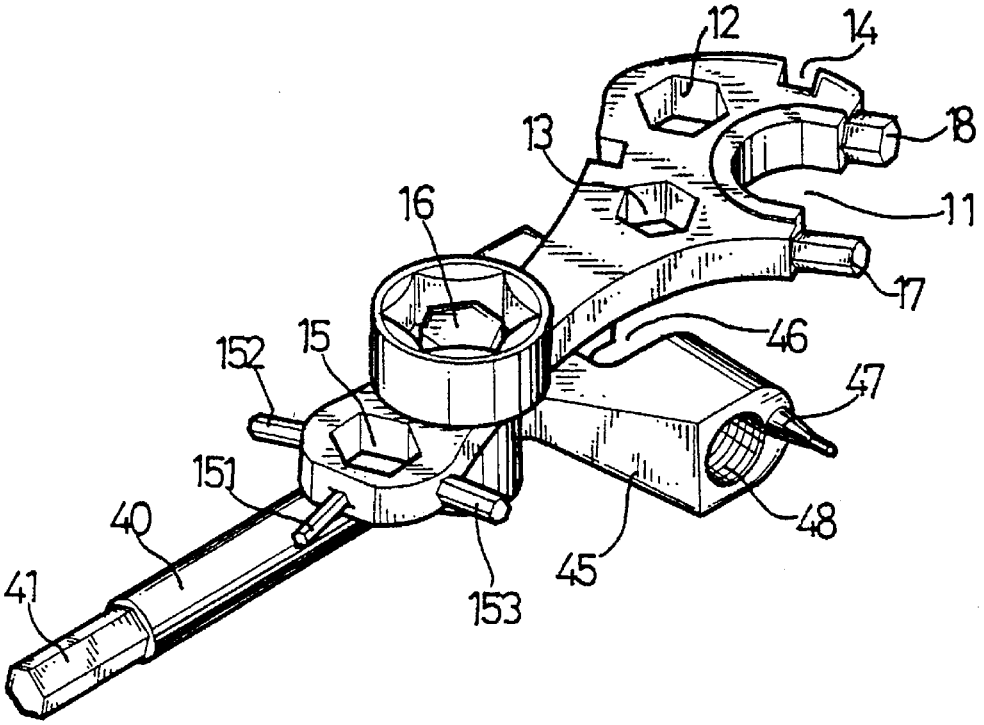
FIG. 2 is a perspective view illustrating the applications of the tool combination.
Figure 3:
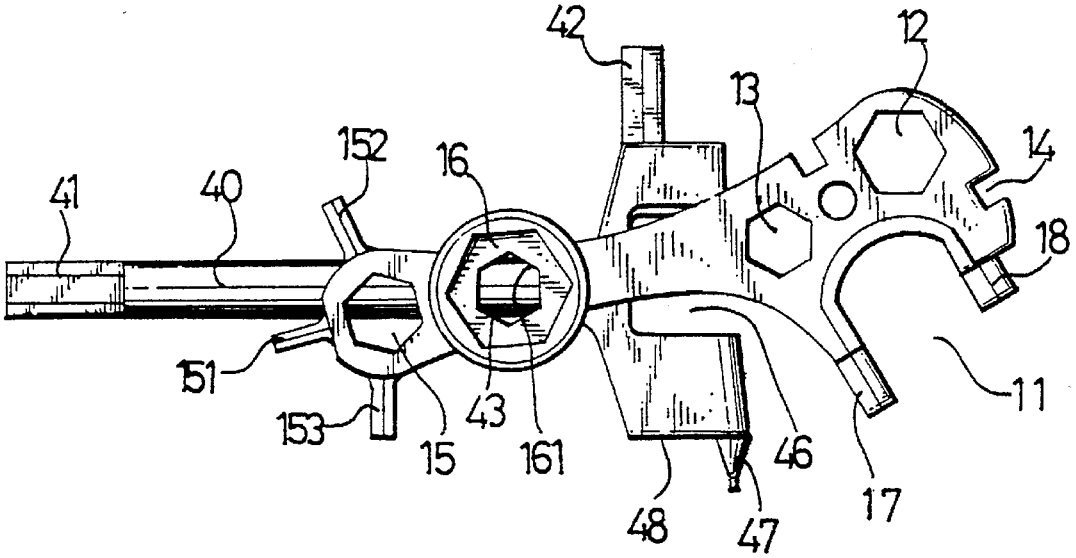
FIGS. 3, 4, 5 are plane views illustrating the applications of the tool combination.
Figure 4:
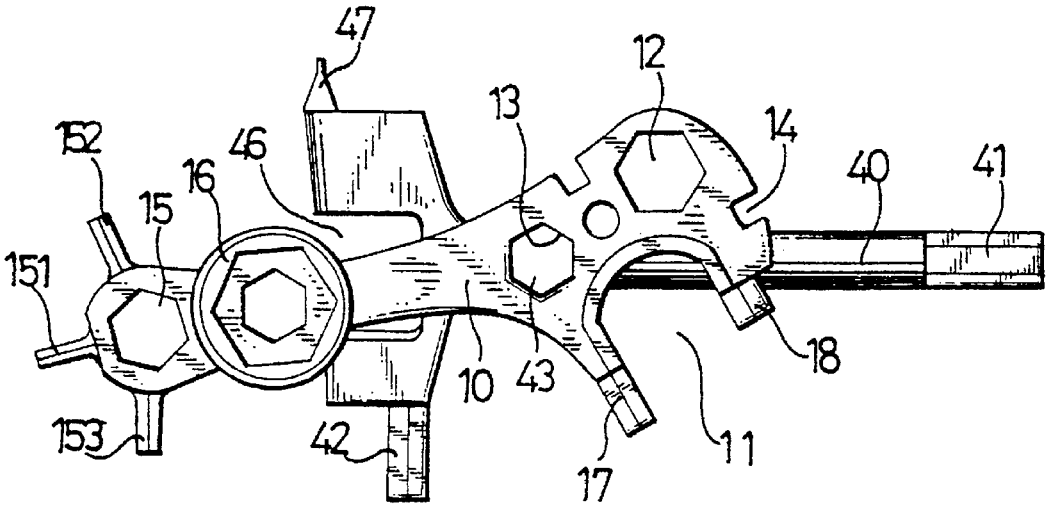
Figure 5:
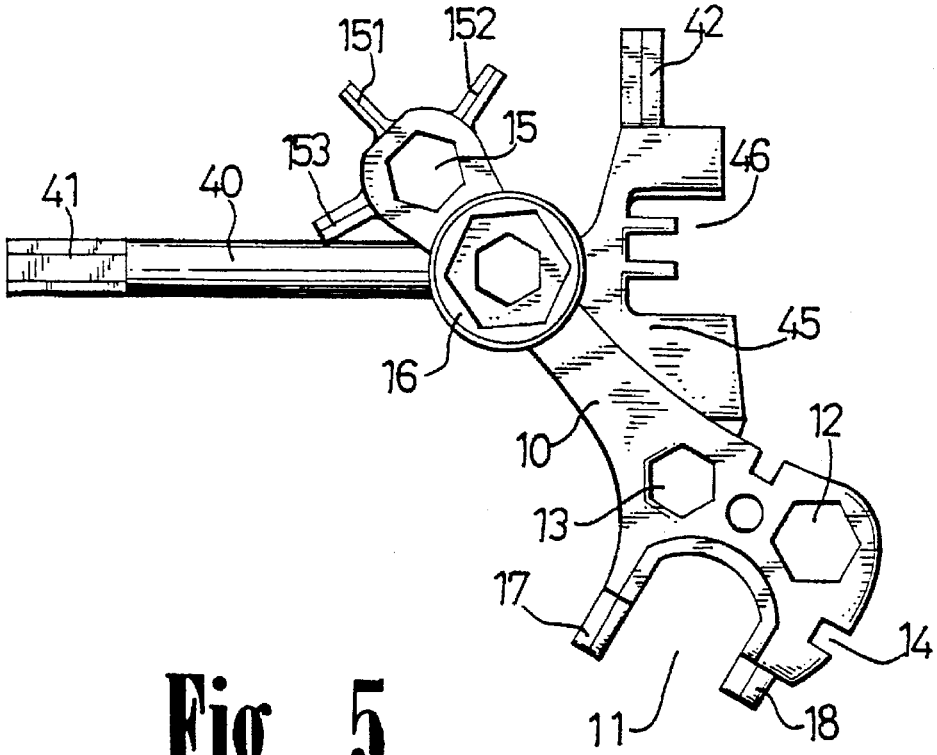

Referring to the drawings, and initially to FIGS. 1 to 3, a tool combination in accordance with the present invention comprises a body 10 including a wrench type engaging opening 11 and two notches 14 formed in the peripheral portion of one end portion thereof, including two engaging holes 12, 13 formed in the one end thereof, and including two driving tool bits 17, 18 extended from the one end thereof, such as wrench driving bits or screw driver bits. The other end portion of the body 10 includes a socket 16 secured thereon and includes an aperture 161 formed therein and communicating with the socket 16. The other end portion of the body 10 also includes an engaging hole 15 formed therein and includes three driving tool bits 151, 152, 153 extended therefrom.

A rod 40 includes a stud or a driving tool bit 41 formed on one end thereof and includes a block 45 secured to the other end thereof and perpendicular to the rod 40. The block 45 includes a driving tool bit 42 extended from one end thereof and includes a middle portion having a slot 46 formed therein for engaging with and for retaining the bicycle chain in place. The other end of the block 45 includes a screw hole 48 formed therein for engaging with a bolt 30 which includes an extension 31 extended inward of the slot 46 for disengaging the pivot shafts of the chains and for forcing the pivot shafts into place so as to adjust the tightness of the chains. The block 45 includes a projection 47 extended therefrom. A socket 44 and a driving tool bit 43 are provided between the block 45 and the rod 40. The tool bit 43 may be engaged in the aperture 161 and the rod 40 may be aligned with the body 10 so as to form a compact configuration which is excellent for storing and for transportation purposes.

In operation, as shown in FIGS. 2 and 3, the tool bit 43 may be engaged in the aperture 161 and the rod 40 may be extended away from the body 10 so as to extend the torque length of the tool combination. The engaging opening 11 may be used for unthreading the main axle of the wheel axle. The notches 14 may be used for unthreading the fastening portions of the spokes. The tool bit 43 may also be engaged in the engaging holes 12, 13 for extending the torque length of the other end of the body 10. The extension 31 of the bolt 30 may be forced toward the chain engaged in the slot 46 and may force the pivot shafts of the chain outward from the chain so as to change the length of the chain and so as to adjust the tightness of the chain. The driving tool bits 151, 152, 153, 17, 18, 41 42, 43 and the sockets 16, 44 include different sizes and may be provided for driving various kinds of fastening members. The engaging holes 12, 13, 15 and the engaging notches 14 may also be provided for engaging with and for driving various kinds of fastening members.

Accordingly, the tool combination for bicycles in accordance with the present invention includes a rather compact configuration having a number of driving tool bits and a number of engaging holes provided therein for driving various kinds fastening members. The driving tool bits will not be disengaged from the body and the rod. The tool combination includes a means for disengaging and for replacing pivot shafts of the chains in order to adjust the tightness of the chains.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination for a bicycle comprising:

a body including a first end having a first socket secured thereon and having a first engaging hole formed therein and communicating with said socket, said body including at least one first driving means provided thereon and including at least one second engaging hole formed therein, and a rod including a first end having a block secured thereto and including a second socket and a third driving means formed between said rod and said block for engaging with said first engaging hole of said body so as to extend a driving length of said body.

2. A tool combination according to claim 1, wherein said block includes a middle portion having a slot formed therein for engaging with chain means having pivot shafts therein, said block includes a first end having a screw hole formed therein for engaging with a bolt means, said bolt means includes an extension for disengaging the pivot shafts from the chain means.

* * * * *